US005793338A

United States Patent [19]

Standke et al.

[11] Patent Number: 5,793,338

[45] Date of Patent: *Aug. 11, 1998

[54] QUADRIFILAR HELIX ANTENNA AND FEED NETWORK

[75] Inventors: Randolph E. Standke, San Diego; James H. Thompson, Carlsbad, both of Calif.

[73] Assignee: Qualcomm Incorporated, San Diego, Calif.

[ * ] Notice: The term of this patent shall not extend beyond the expiration date of Pat. No. 5,572,172.

[21] Appl. No.: 513,317

[22] Filed: Aug. 9, 1995

[51] Int. Cl.[6] ..... H01Q 1/36

[52] U.S. Cl. ..... 343/895; 333/26

[58] Field of Search ..... 343/895, 859; 333/126, 117, 161, 26; H01Q 1/38

[56] References Cited

U.S. PATENT DOCUMENTS

| | | | |
|---|---|---|---|
| 3,423,688 | 1/1969 | Seidel | 333/117 |
| 3,641,578 | 2/1972 | Spanos et al. | 333/117 X |
| 3,678,418 | 7/1972 | Oakley et al. | 333/26 |
| 3,838,364 | 9/1974 | Kurokawa | 333/117 X |
| 4,673,897 | 6/1987 | Chua et al. | 333/26 |
| 4,849,767 | 7/1989 | Naitou | 343/745 |
| 4,896,123 | 1/1990 | Taub | 333/117 X |
| 4,935,747 | 6/1990 | Yuichi et al. | 343/895 |
| 4,961,061 | 10/1990 | Cruchon et al. | 333/117 X |
| 5,041,842 | 8/1991 | Blaese | 343/882 |
| 5,134,422 | 7/1992 | Auriol | 343/895 |
| 5,138,331 | 8/1992 | Josypenko | 343/895 |
| 5,191,352 | 3/1993 | Branson | 343/895 |
| 5,298,910 | 3/1994 | Takei et al. | 343/895 |
| 5,317,327 | 5/1994 | Piole | 343/725 |
| 5,329,287 | 7/1994 | Strickland | 343/752 |
| 5,345,248 | 9/1994 | Hwang et al. | 343/895 |
| 5,355,104 | 10/1994 | Wolfson et al. | 333/161 |
| 5,359,340 | 10/1994 | Yokota | 343/792 |
| 5,370,677 | 12/1994 | Rudie et al. | 607/101 |
| 5,444,455 | 8/1995 | Louzir et al. | 343/895 |

FOREIGN PATENT DOCUMENTS

| | | | |
|---|---|---|---|
| 0427654 | 5/1991 | European Pat. Off. | H01Q 11/08 |
| 0521511 | 1/1993 | European Pat. Off. | H01Q 11/08 |
| 3625113 | 7/1986 | Germany | H01Q 9/16 |
| 9205602 | 4/1992 | WIPO | H01Q 11/08 |

OTHER PUBLICATIONS

Randolph W. Bricker, Jr., "A Shaped-Beam Antenna for Satellite Data Communication", Institute of Electrical and Electronics Engineers, 11–15 Oct., 1976, pp. 121–126.

*Primary Examiner*—Donald T. Hajec
*Assistant Examiner*—Tho Phan
*Attorney, Agent, or Firm*—Russell B. Miller; Gregory D. Ogrod

[57] ABSTRACT

A quadrifilar antenna is comprised of four radiators which, in the preferred embodiment, are etched onto a radiator portion of a microstrip substrate. The microstrip substrate is formed into a cylindrical shape such that the radiators are helically wound. Also etched onto the microstrip substrate is a feed network that provides 0°, 90°, 180° and 270° signals to the antenna radiators. The feed network utilizes a combination of one or more branch line couplers and one or more power dividers to accept an input signal from a transmitter and to provide therefrom the 0°, 90°, 180° and 270° signals needed to drive the antenna. For receive operations, the feed network utilizes these same components to receive the 0°, 90°, 180° and 270° signals from the antenna radiators and to provide a single output signal to a communications receiver. The power divider accepts an input signal and provides therefrom two output signals differing from each other in phase by 180°. The branch line coupler accepts an input signal and provides therefrom two output signals differing from one another in phase by 90°.

12 Claims, 19 Drawing Sheets

| FIG 11A | FIG 11B | FIG 11C |
|---|---|---|

QUADRIFILAR HELIX ANTENNA AND FEED NETWORK

RELATED APPLICATIONS

This application is related to a commonly owned application filed on even date herewith entitled "180° Power Divider for a Helix Antenna" and having Ser. No. 08/513,163, the full disclosure of which is incorporated herein by reference as if reproduced in full below.

BACKGROUND OF THE INVENTION

1. Field of the Invention

The present invention relates generally to helix antennas, and more specifically to a quadrifilar helix antenna and feed network.

2. Related Art

Many contemporary communications and navigation products have been developed that rely on earth-orbiting satellites to provide necessary communications and navigation signals. Examples of such products include satellite navigation systems, satellite tracking and locator systems, and communications systems which rely on satellites to relay the communications signals from one station to another. These and other communications systems often utilize antennas which require a feed network that is capable of providing multiple signals of different phases.

Advances in electronics in the areas of packaging, power consumption, miniaturization, and production, have generally resulted in the availability of such products in a portable package at a price point that is attractive for many commercial and individual consumers. However, one area in which further development is needed is the antenna used to provide communications with the satellite. Typically, antennas suitable for use in the appropriate frequency range are larger than would be desired for use with a portable device. Often times the antennas are implemented using microstrip technology. However, in such antennas, the feed networks are often larger than would be desired or exhibit unwanted characteristics.

SUMMARY OF THE INVENTION

The present invention is directed toward a quadrifilar helix antenna and feed network. A quadrifilar antenna is comprised of four radiators which, in the preferred embodiment, are etched onto a radiator portion of a thin substrate. The substrate is formed into a cylindrical shape such that the radiators are helically wound. Also etched onto the microstrip substrate is a feed network. For transmit operations, the feed network accepts an input transmit signal and performs the necessary power division and phasing to provide the phases necessary to feed the radiators of the antenna. For receive operations, the feed network accepts and combines signals received from the radiators. The feed networks presented herein are described in terms of phase shifting the input signal to provide the transmit signals for the radiators. It should be understand that these networks also work for the receive circuit as well.

Also disclosed herein are various feed networks utilized to provide the interface between a feed line and the antenna elements. According to the feed networks described herein, three components can be utilized in various combinations to provide the 0°, 90°, 180° and 270° signals needed to drive the antenna. One such component is a branch-line coupler and another is a 180° power divider. The branch line coupler accepts an input signal and splits this input signal into two output signals. The two output signals are equal in amplitude and differ in phase by 90°.

The 180° power divider accepts an input signal and splits it into two output signals. The two output signals are equal in amplitude and differ in phase by 180°. The manner in which the 180° power divider accomplishes this is as follows: The input signal travels along a trace on a circuit surface of the microstrip substrate. On the opposite surface of a microstrip is an electrically infinite ground plane. In this region, the input signal is an unbalanced signal.

In a second region, the ground plane is discontinued, except in the area directly opposite the signal trace. In this area, the ground plane tapers from the electrically infinite ground plane to a width that is substantially equal to the width of the signal trace. As a result, opposite the signal trace is a second trace of substantially the same width, referred to as a return signal trace. In this region, the signal is a balanced signal, and for the current flowing in the signal trace, there is an equal but opposite current flowing in the return signal trace on the opposite side. This return signal trace is brought to the circuit surface of the microstrip substrate and the ground plane resumes once again on the opposite surface.

Further embodiments, features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears. It should be noted that the drawings are not necessarily drawn to scale, especially where radiating portions of antennas are illustrated.

FIG. 5(*b*) illustrates the connection of a feed line to a radiator according to one embodiment.

FIG. 5(*c*) illustrates the connection of a feed line to a radiator according to an alternative embodiment.

FIG. 6(*b*) illustrates a top surface of an etched substrate of a microstrip quadrifilar helix antenna according to another embodiment of the invention.

FIG. 17(*b*) illustrates a cross-sectional view of the cross-over section illustrated in FIG. 17(*a*).

DETAILED DESCRIPTION OF THE EMBODIMENTS

1. Overview and Discussion of the Invention

The present invention is directed toward a quadrifilar helix antenna and feed networks. According to the quadrifilar antenna disclosed herein, a microstrip substrate is comprised of two sections: a first section having antenna radiators and a second section having an antenna feed network. The microstrip substrate is rolled into a cylinder so that the radiators are helically wound about a central axis.

The feed networks are comprised of a novel and unique structure for providing four signals having relative phase differences of 0°, 90°, 180° and 270° to drive a helical antenna. The feed network can include a combination of components such as branch line couplers and 180° power dividers.

2. Quadrifilar Helix Antenna

A quadrifilar antenna is now described with reference to FIGS. 1–6. PIG. 1 illustrates a quadrifilar helix microstrip antenna 100. The antenna 100 is comprised of radiators 104 etched onto a substrate 108. The substrate is a thin film flexible material that is rolled into a cylinder such that radiators 104 are helically wound about the axis of the cylinder.

Figure 3:
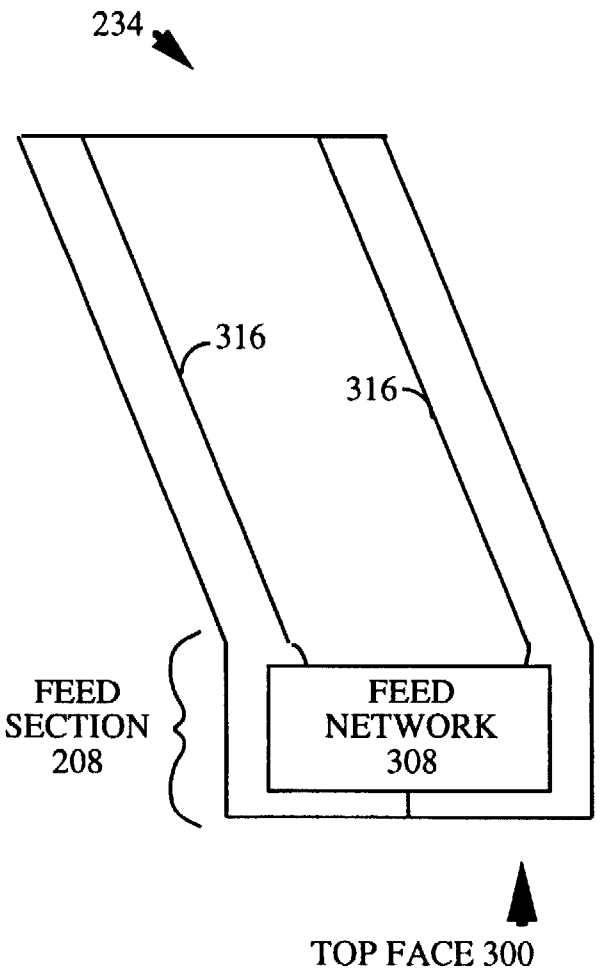
FIG. 3 illustrates a top surface of an etched substrate of a microstrip quadrifilar helix antenna according to an infinite balun feed embodiment of the invention.
Figure 2:
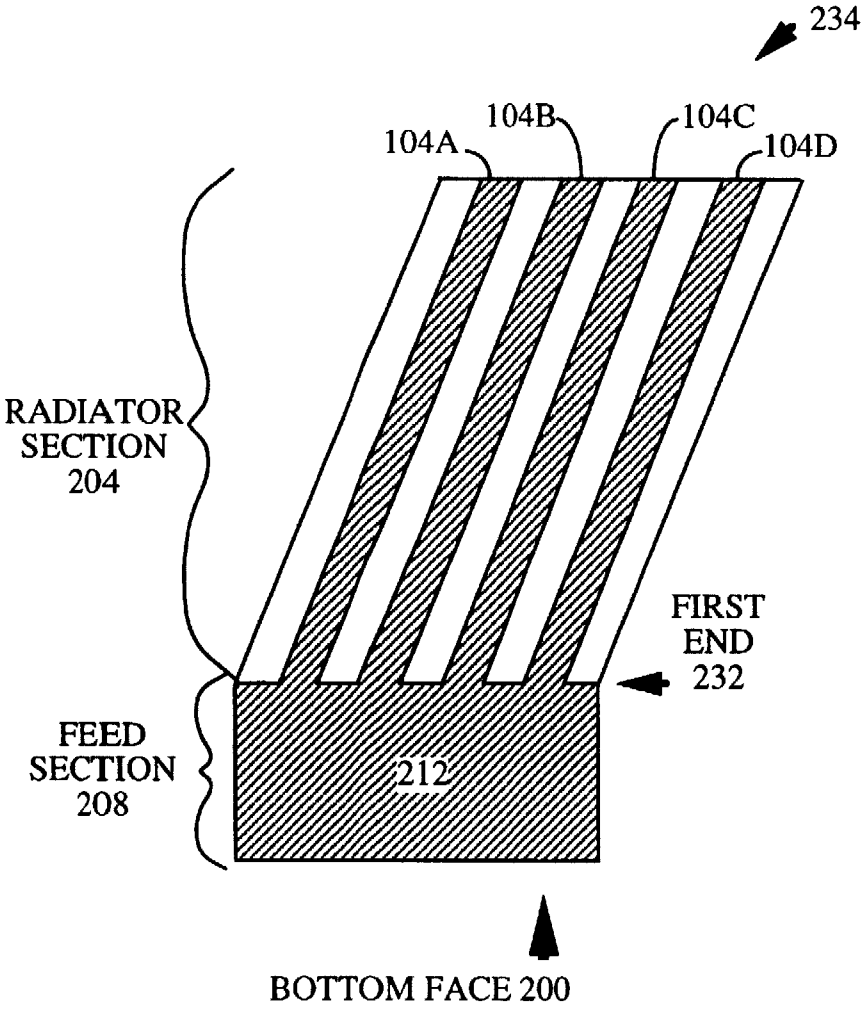
FIG. 2 illustrates a bottom surface of an etched substrate of a microstrip quadrifilar helix antenna according to an infinite balun feed embodiment of the invention.
Figure 4:
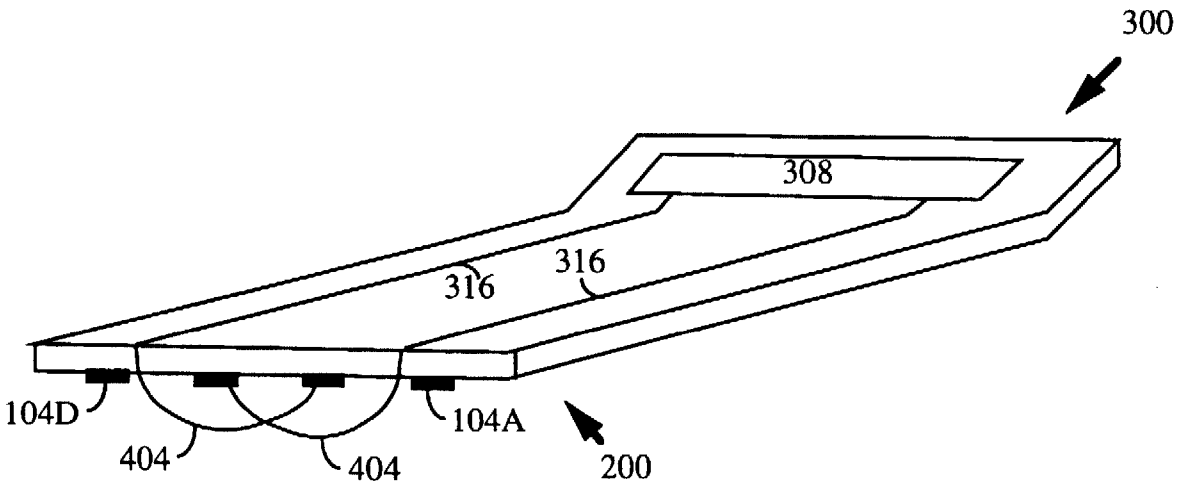
FIG. 4 illustrates a perspective view of an etched substrate of a microstrip quadrifilar helix antenna according to an infinite balun feed embodiment of the invention.

FIGS. 2–4 illustrate the components used to fabricate quadrifilar helix antenna 100. FIGS. 2 and 3 present a view of a bottom surface 200 and top surface 300 of substrate 108, respectively. Substrate 108 includes a radiator section 204, and a feed section 208.

Note that throughout this document, the surfaces of substrate 108 are referred to as a "top" surface and a "bottom" surface. This nomenclature is adopted for ease of description only and the use of such nomenclature should not be construed to mandate a specific spatial orientation of substrate 108. Furthermore, in the embodiments described and illustrated herein, the antennas are described as being made by forming the substrate into a cylindrical shape with the top surface being on the outer surface of the formed cylinder. In alternative embodiments, the substrate is formed into the cylindrical shape with the bottom surface being on the outer surface of the cylinder.

In a preferred embodiment, microstrip substrate 100 is a thin, flexible layer of polytetraflouroethalene (PTFE), a PTFE/glass composite, or other dielectric material. Preferably, substrate 100 is on the order of 0.005 in., or 0.13 mm. thick. Signal traces and ground traces are provided using copper. In alternative embodiments, other conducting materials can be chosen in place of copper depending on cost, environmental considerations and other factors.

A feed network 308 is etched onto feed section 208 to provide the 0°, 90°, 180° and 270° signals that are provided to radiators 104. Feed section 208 of bottom surface 200 provides a ground plane 212 for feed circuit 308. Signal traces for feed circuit 308 are etched onto top surface 300 of feed section 208. Specific embodiments for feed circuit 308 are described in detail below in Section 4.

For purposes of discussion, radiator section 204 has a first end 232 adjacent to feed section 208 and a second end 234 (on the opposite end of radiator section 204). Depending on the antenna embodiment implemented, radiators 104 can be etched into bottom surface 200 of radiator section 204. The length at which radiators 104 extend from first end 232 toward second end 234 depends on the feed point of the antenna, and on other design considerations such as the desired radiation pattern. Typically, this length is an integer multiple of a quarter wavelength.

An antenna embodiment having an infinite balun configuration is illustrated in FIGS. 2–5. In this embodiment, radiators 104 on bottom surface 200 extend the length of radiator section 204 from first end 232 to opposite end 234. These radiators are illustrated as radiators 104A, 104B, 104C, and 104D. In this infinite balun embodiment, radiators 104 are fed at second end 234 by feed lines 316 etched onto top surface 300 of radiator section 204. Feed lines 316 extend from first end 232 to second end 234 to feed radiators 104. In this configuration, the feed point is at second end 234. The surface of radiators 104A, 104D contacting substrate 108 (opposite feed lines 316) provide a ground for feed lines 316 which provide the antenna signal from the feed network to the feed point of the antenna.

Figure 5A:
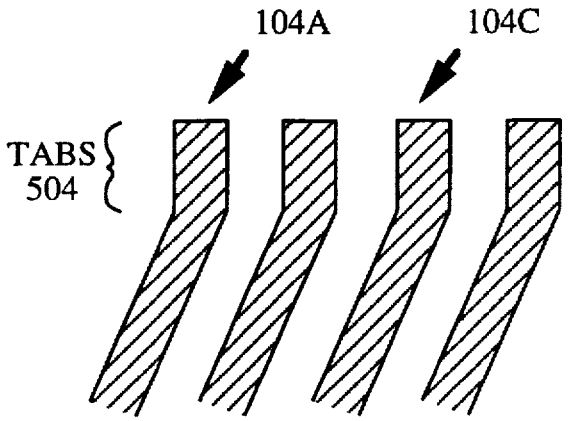
FIG. 5(*a*) illustrates tabs on the antenna radiators.
Figure 5B:
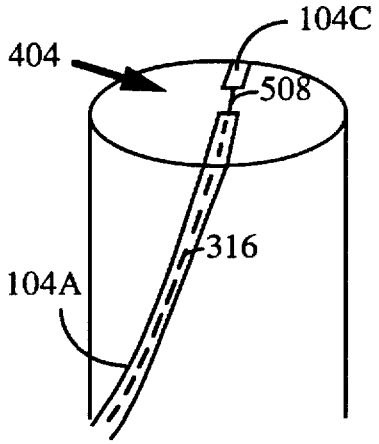
Figure 5C:
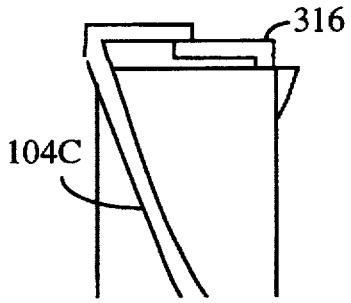

FIG. 4 is a perspective view of the infinite balun embodiment. This view further illustrates feeds 316 and radiators 104 etched onto substrate 108. This view also illustrates the manner in which feeds 316 are connected to radiators 104 using connections 404. Connections 404 are not actually physically made as illustrated in FIG. 4. FIG. 5, which comprises FIGS. 5(*a*), 5(*b*) and 5(*c*) illustrates alternative embodiments for making connections 404. FIG. 5(*a*) is a diagram illustrating a partial view of radiator section 204. According to this embodiment, radiators 104 are provided with tabs 504 at second end 234. When the antenna is rolled into a cylinder, the appropriate radiator/feedline pairs are connected. Examples of such connection are illustrated in FIGS. 5(*b*) and 5(*c*), where tabs 504 are folded toward the center of the cylinder.

In the embodiment illustrated in FIG. 5(*b*), connection 404 is implemented by soldering (or otherwise electrically connecting) radiator 104C and feed line 316 using a short conductor 508. In FIG. 5(*b*) feed line 316 is on the inside surface of the cylinder and is therefore illustrated as a dashed line.

In the embodiment illustrated in FIG. 5(*c*), radiator 104A and the feed line 316 on the opposite surface are folded toward the center of the cylinder, overlapped and electrically connected at the point of overlap, preferably by soldering the appropriate feed line 316 to its associated radiator, here, 104C.

Figure 6B:
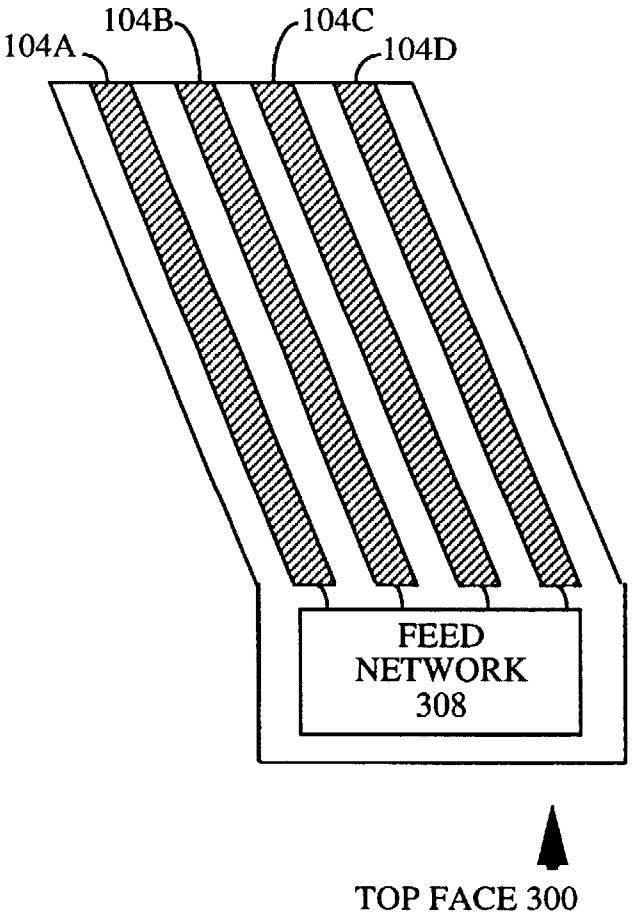
FIG. 6(*a*) illustrates a bottom surface of an etched substrate of a microstrip quadrifilar helix antenna according to another embodiment of the invention.
Figure 6A:
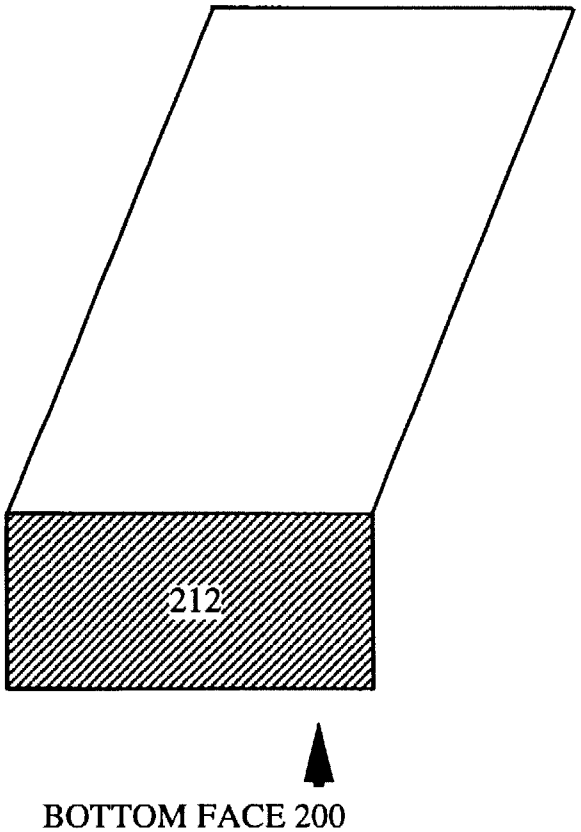

A more straightforward embodiment than the infinite balun embodiment just described, is illustrated in FIG. 6, which comprises FIGS. 6(*a*) and 6(*b*). FIG. 6(*a*) illustrates bottom surface 200; FIG. 6(*b*) illustrates top surface 300. In this embodiment, radiators 104 are etched onto top surface 300 and are fed at first end 232. These radiators are illustrated as radiators 104A, 104B, 104C, and 104D. In this embodiment, radiators 104 are not provided on bottom surface 200.

Because these radiators are fed at first end 232, there is no need for the balun feed lines 316 which were required in the infinite balun feed embodiment. Thus, this embodiment is generally easier to implement and any losses introduced by feed lines 316 can be avoided.

Figure 16:
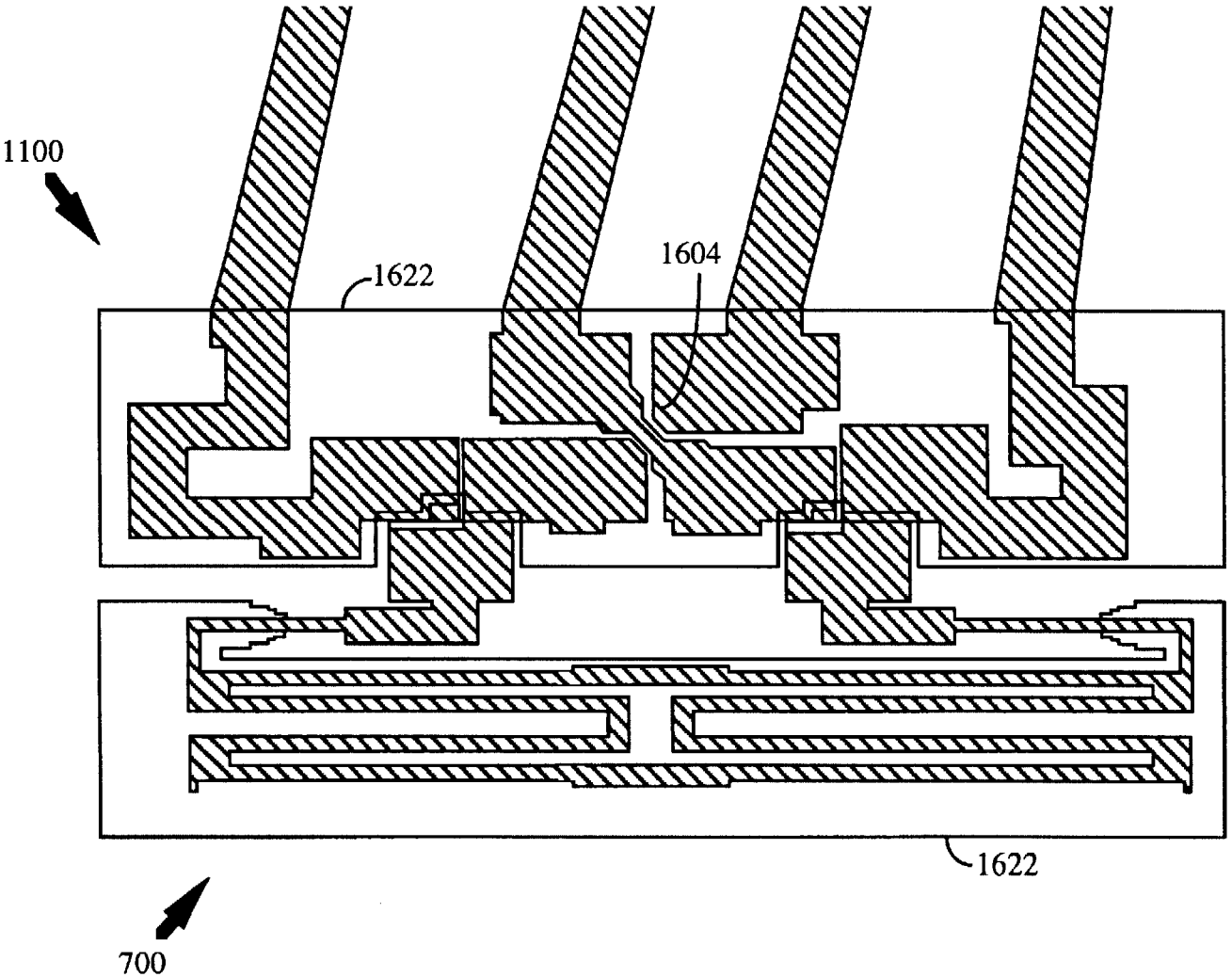
FIG. 16 illustrates an exemplary implementation of a feed network having two 180° power dividers and a single-section branch-line coupler.

Note that in the embodiment illustrated in FIGS. 6(*a*) and 6(*b*), the length of radiators 104 is an integer multiple of $\lambda/2$, where $\lambda$ is the wavelength of the center frequency of the antenna. In such an embodiment where radiators 104 are an integer multiple of $\lambda/2$, radiators 104 are electrically connected together at second end 234. This connection can be made by a conductor across second end 234 which forms a ring around the circumference of the antenna when the substrate is formed into a cylinder. An example of this embodiment is illustrated in FIG. 16. In an alternative implementation where the length of radiators 104 is an odd integer multiple of $\lambda/4$, radiators 104 are left electrically open at second end 234 to allow the antenna to resonate at the center frequency.

3. Branch Line Couplers

Figure 7:
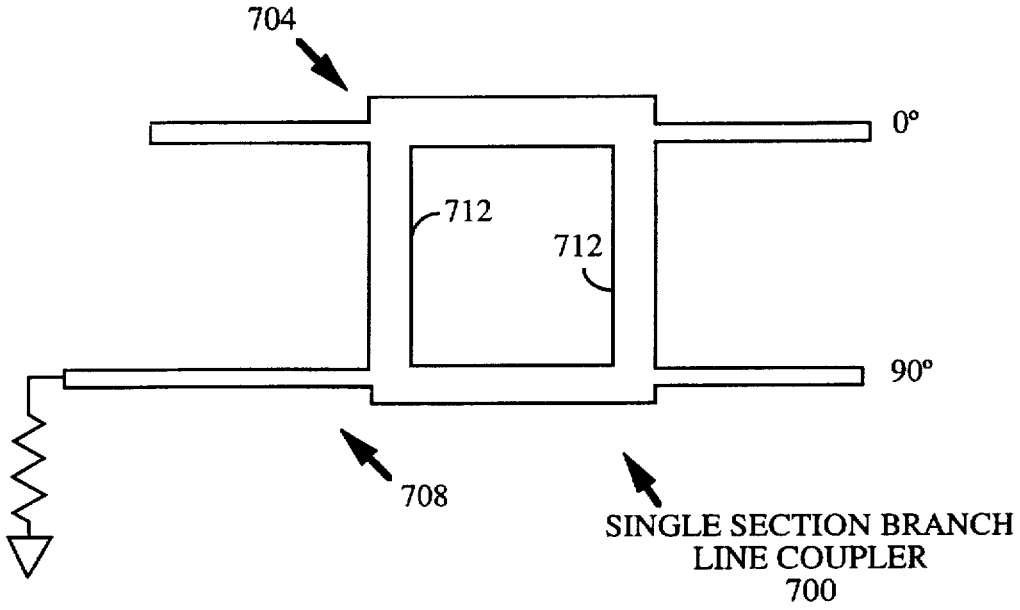
FIG. 7 illustrates a single-section branch line coupler exhibiting narrow-band frequency response characteristics.

Branch line couplers have been used as a simple and inexpensive means for power division and directional coupling. A single section, narrow band branch line coupler 700 is illustrated in FIG. 7. Coupler 700 includes a mainline branch arm 704, a secondary branch arm 708 and two shunt branch arms 712. The input signal is provided to mainline branch arm 704 (referred to as mainline 704) and coupled to secondary branch arm 708 (referred to as secondary line 708) by shunt branch arms 712. Secondary line 708 is connected to ground at one end preferably with a matched terminating impedance. Preferably, shunt branch arms 712 are one quarter-wavelength long sections separated by one quarter wavelength, thus forming a section having a perimeter length of approximately one wavelength.

At the output, mainline 704 and secondary line 708 each carries an output signal. These signals differ in phase from each other by 90°. Both outputs provide a signal that is roughly half of the power level of the input signal.

Figure 8:
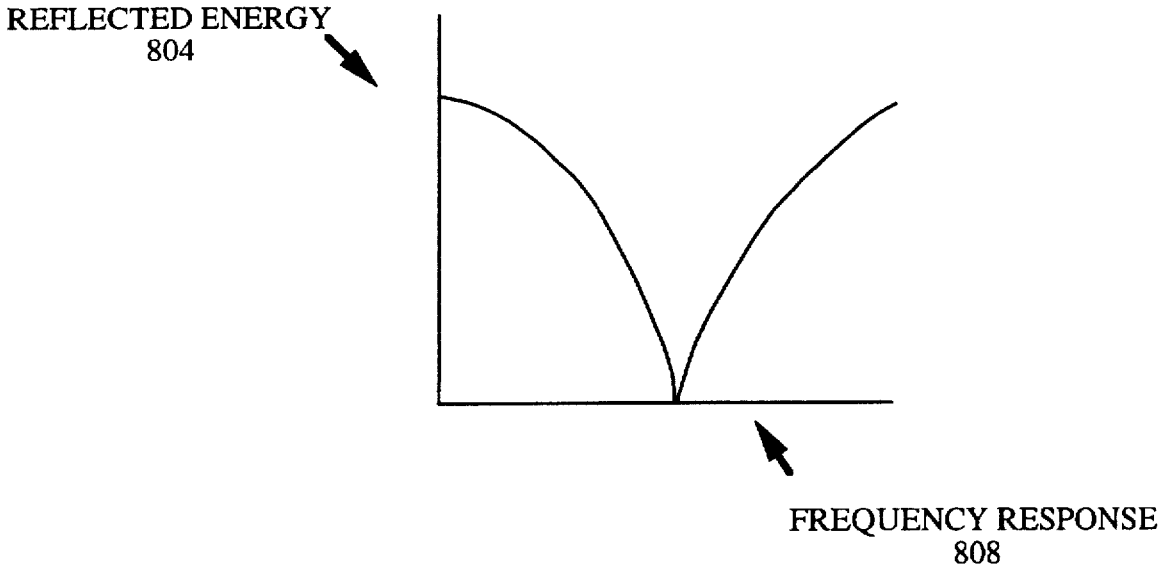
FIG. 8 illustrates the frequency response of the single-section branch line coupler of FIG. 7.

One property of such a single-section branch line coupler 700 is that its frequency response is somewhat narrow. FIG. 8 illustrates the frequency response 808 of a typical single-section branch line coupler 700 in terms of reflected energy 804.

Figure 9:
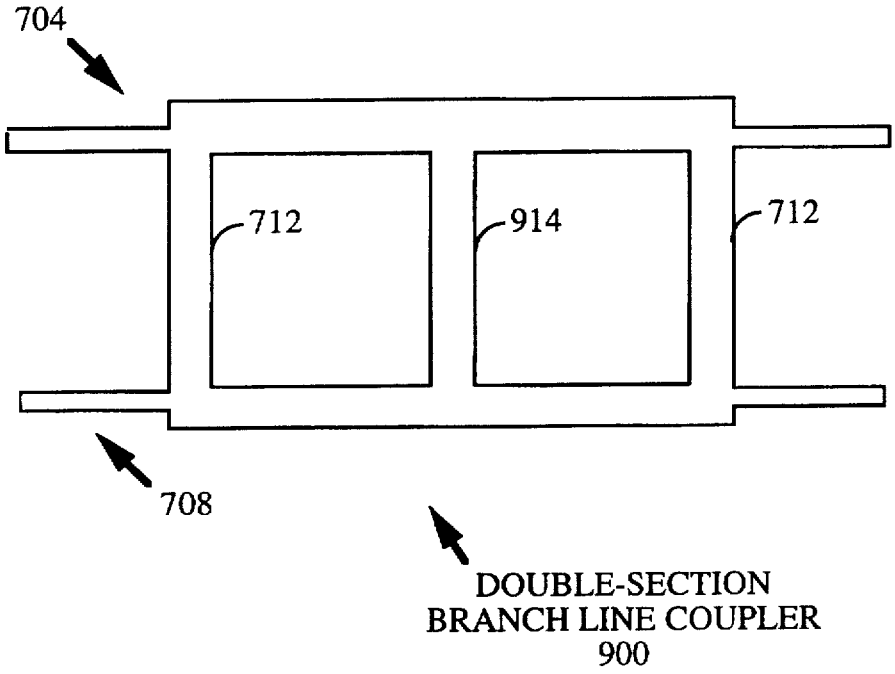
FIG. 9 illustrates a double-section branch line coupler exhibiting broadband frequency response characteristics.

To accommodate a broader range of frequencies, a double-section branch line coupler can be implemented. Such a double-section branch line coupler 900 is illustrated in FIG. 9. A primary physical distinction between single-section branch line coupler 700 and double-section branch line coupler 900 is that double-section branch line coupler 900 includes an additional shunt branch arm 914.

Figure 10:
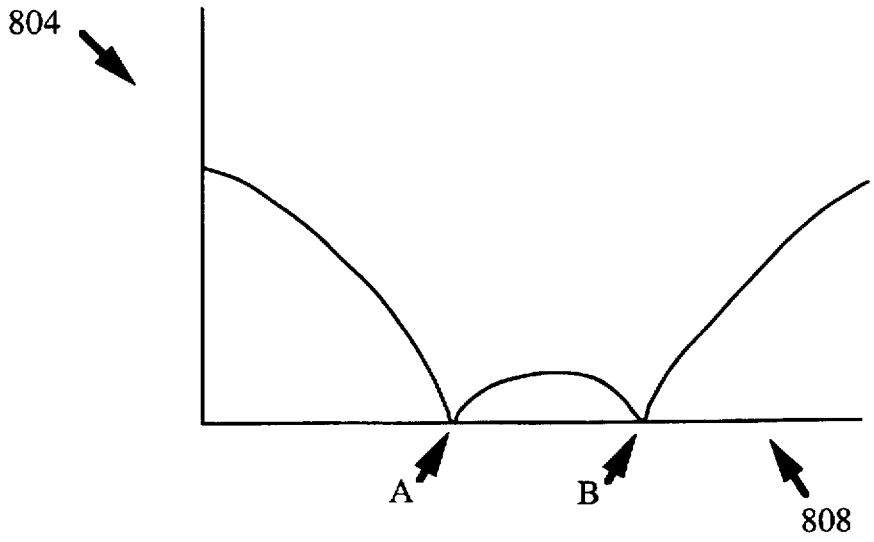
FIG. 10 illustrates the frequency response of the double-section branch line coupler of FIG. 7.

An advantage of double-section branch line coupler 900 over single-section branch line coupler 700, is that the double-section branch line coupler 900 provides a broader frequency response. That is, the frequency range over which the reflected energy is below an acceptable level is broader than that of the single-section branch line coupler 700. The frequency response for a typical double-section branch line coupler is illustrated in FIG. 10. However, for true broadband applications, the double-section branch line coupler 900 may still not be perfectly ideal due to the level of reflected energy 804 encountered in the operating frequency range.

4. Feed Networks

The quadrifilar helix antennas described above in Section 2 as well as certain other antennas require a feed network to provide the 0°, 90°, 180° and 270° signals needed to drive antenna radiators 104. Described in this Section 4 are several feed networks that can be implemented to perform this interface between radiators 104 and the feed line to the antenna. The feed networks are described in terms of several components: a 180° power divider, single-section branch line couplers 700 and double-section branch line couplers 900.

Figures 11, 11A:
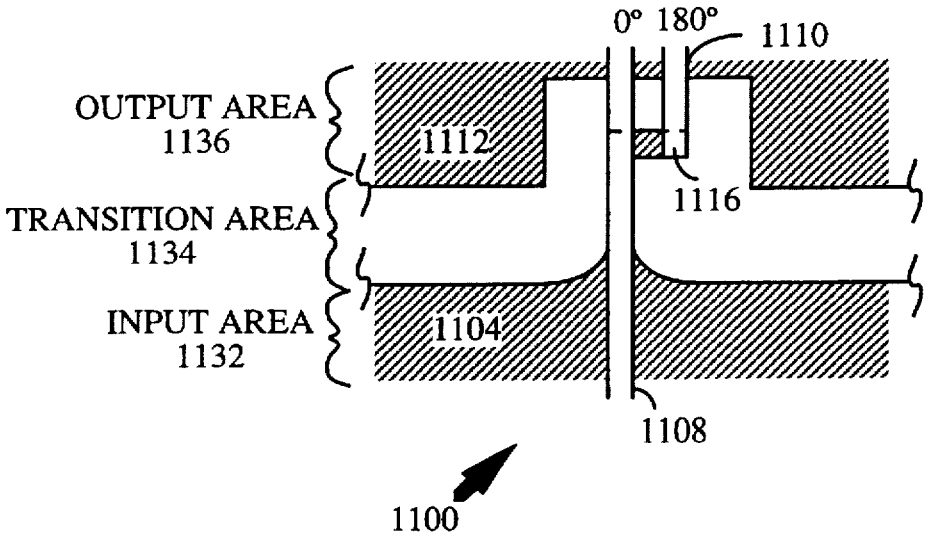
FIG. 11, which comprises FIGS. 11(*a*), 11(*b*) and 11(*c*), illustrates a 180° power divider.
Figure 11B:
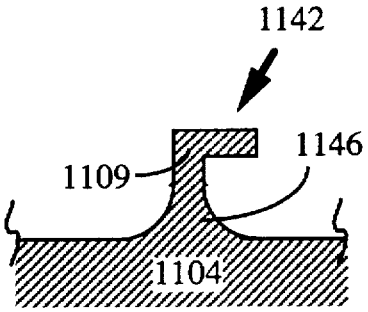
Figure 11C:
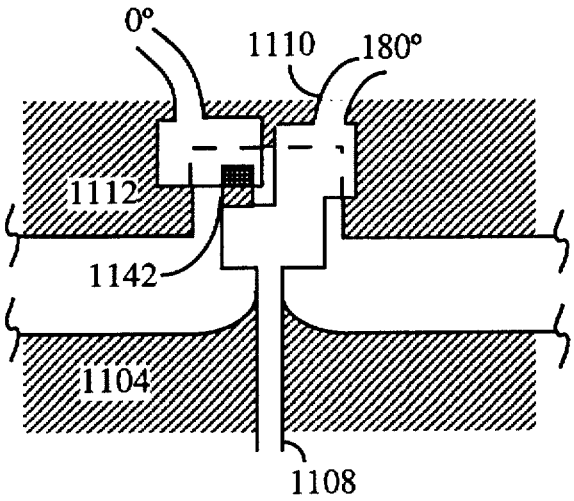
Figure 12:
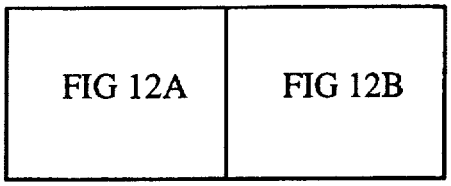
FIG. 12, which comprises FIGS. 12(*a*) and 12(*b*), illustrates unbalanced microstrip and balanced parallel plate signal paths and their electric field patterns.
Figure 12A:
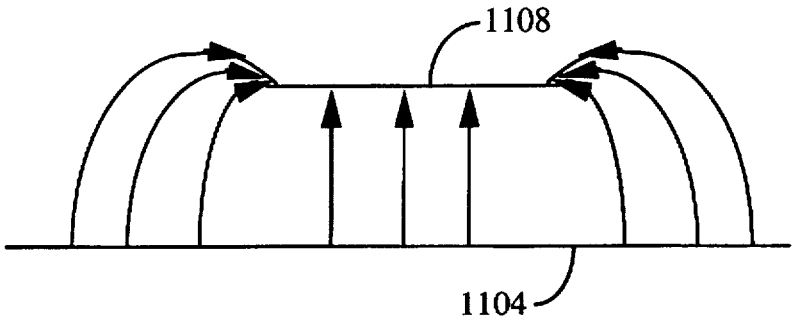
Figure 12B:
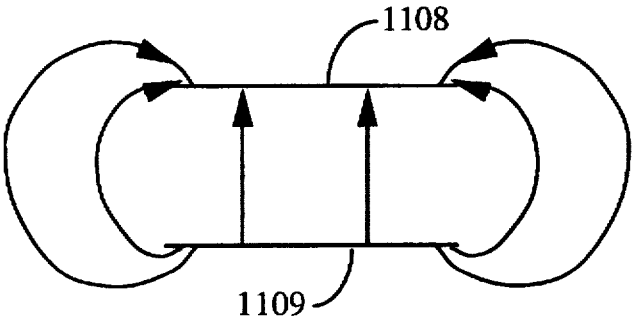

One element used in providing the needed phases is a 180° power divider. This 180° power divider is now described with reference to FIGS. 11 and 12. FIG. 11 comprises FIGS. 11(*a*), 11(*b*) and 11(*c*). FIG. 12 comprises FIGS. 12(*a*) and 12(*b*). The concept behind this 180° power divider is that the signal is transitioned from a balanced signal to an unbalanced signal by altering the ground portion of the conductive signal path. FIG. 11(*a*) illustrates one embodiment of a 180° power divider 1100. Both surfaces of 180° power divider 1100 implemented using microstrip technology are illustrated in FIG. 11, as if substrate 108 is transparent. For ease of discussion, 180° power divider 1100 is described as having three areas: an input area 1132, a transition area 1134, and an output area 1136.

According to the embodiment illustrated, a conductive path 1108 is provided on top surface 300 of a feed portion 208 of an antenna. Conductive path 1108 accepts an input signal that is to be split into two signals of substantially equal amplitude that differ in phase by 180°. At input area 1134, conductive path 1108 on top surface 300 is provided with an effectively infinite ground plane 1104 on bottom surface 200. As long as conductive path 1108 has ground plane 1104 opposite it, the input signal carried by conductive path 1108 is an unbalanced signal. This concept is illustrated in FIG. 12(*a*) which shows conductive path 1108 of a finite width and ground plane 1104 opposite the conductive path 1108. The field lines illustrate the field pattern between conductive path 1108 and ground plane 1104.

At transition area 1134, conductive path 1108 continues, but ground plane 1104 tapers down to a width that is substantially equal to the width of conductive path 1108. This is illustrated in FIGS. 11(*a*) and 11(*b*) as tapered portion 1146 and return conductive path 1109. Note that return conductive path 1109 on bottom surface 200 is in substantial alignment with conductive path 1108 on top surface 300. In other words, conductive path 1108 and return conductive path 1109 are disposed along the same longitudinal axis.

As the input signal travels along conductive path 1108 in the area opposite tapered ground portion 1146, the signal transitions from an unbalanced to a balanced signal. Where the ground portion and conductive path 1108 are substantially the same width (i.e., where conductive path 1108 is substantially aligned with return conductive path 1109), the signal is a balanced signal A cross section of conductive path 1108 adjacent conductive path 1109 is illustrated in FIG. 12(*b*). The field lines illustrate the field pattern between conductive path 1108 and ground plane 1104 (now part of the balanced signal path). The balanced signal path is made up of conductive path 1108, and return conductive path 1109.

Because the signal is now balanced, the current flowing on return conductive path 1109 is equal to and the opposite of the current in conductive path 1108. Thus, the signal on return conductive path 1109 is 180° out of phase with the signal on conductive path 1108 in output area 1136. Therefore, in output area 1136 two signals are present, the signal on conductive path 1108 (referred to as the 0° signal), and the 180° signal that is created on conductive path 1109.

To provide the 180° signal to the antenna radiators 104, or to other circuits in feed network 308, the 180° signal can be brought to top surface 300 using a via 1116 (or a plated-through hole or other like connection device) and the signal continues on conductive path 1110 which is on top surface 300. On the opposite surface (bottom surface 200) floating ground plane 1112 provides an effective infinite ground for the signal on conductive path 1110. Note that ground plane 1112 is floating with respect to ground plane 1104.

For clarity, one embodiment of the bottom surface 200 is shown by itself in FIG. 11(*b*). This illustrates ground plane 1104, tapered portion 1146, and return conductive path 1109. Also illustrated in FIG. 11(*b*) is a tab 1142, which is an extension of return conductive path 1109 away from the longitudinal axis along which conductive path 1108 and return conductive path 1109 are disposed. Tab 1142 provides an area where return conductive path 1109 connects to via 1116 to bring the 180° return signal to top surface 300. Note that although ground plane 1104, tapered portion 1146, tab 1142 and return conductive path 1109 are described as distinct elements, these can all be provided on the substrate using a continuous conductive material.

Note that although conductive paths 1108 and 1110 are illustrated as having a uniform width, the widths of these conductive paths 1108 and 1110 can be varied. One reason it may be desirable to vary the widths of conductive paths 1108, 1110 is to adjust the impedance of the circuit. In fact, in the embodiment illustrated in FIG. 11(*c*) the width of conductive paths 1108, 1110 is increased near the crossover point resulting in increased capacitance in this area and lowering the characteristic impedance $Z_0$.

Figure 13:
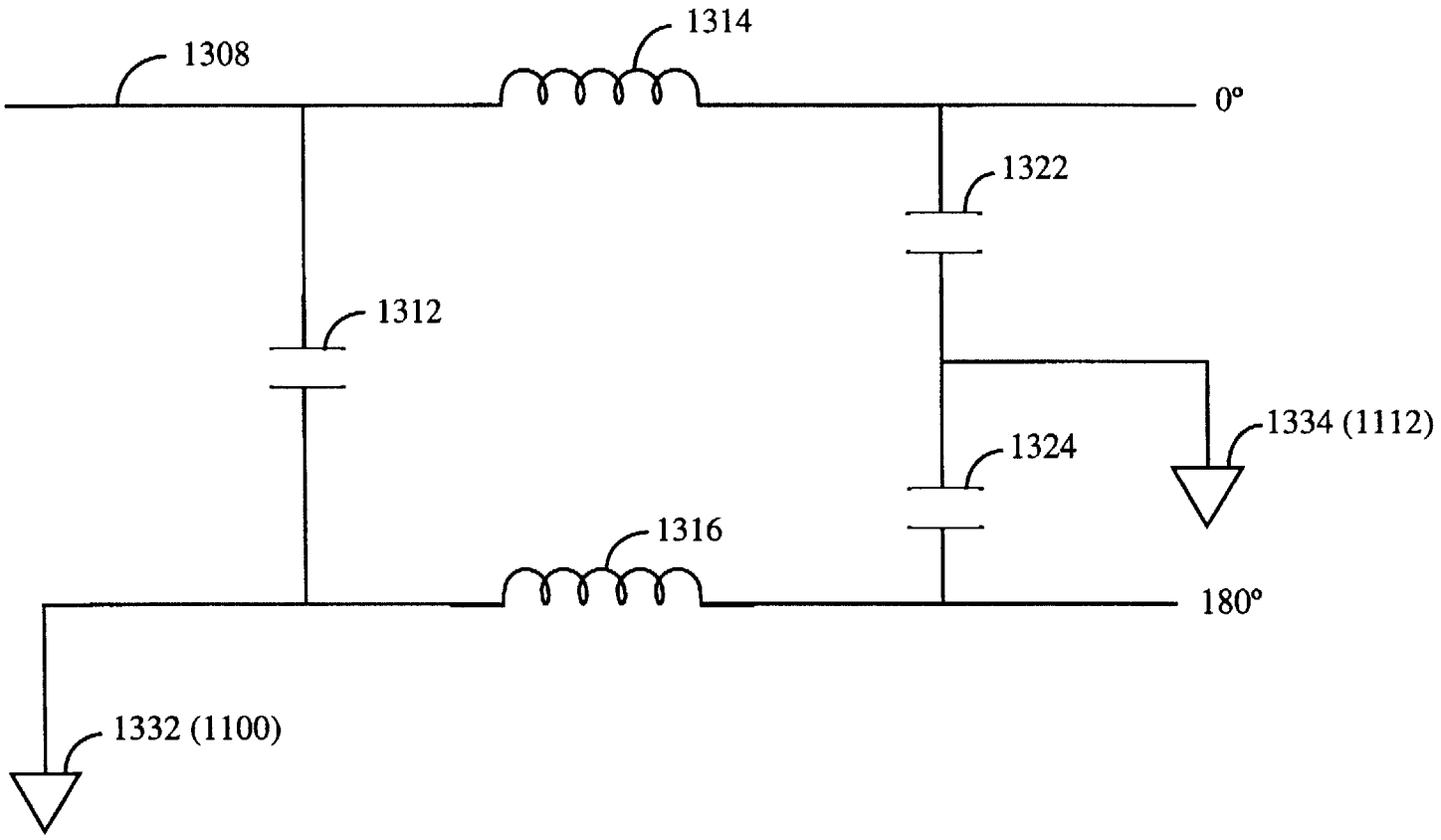
FIG. 13 illustrates a circuit equivalent of the 180° power divider illustrated in FIG. 11.

A circuit equivalent of 180° power divider is illustrated in FIG. 13. This circuit equivalent is now described in terms of FIGS. 11, 12 and 13. As stated above, an input signal is provided on conductive path 1108. In FIG. 13, this is illustrated as input line 1308. The interaction between the input signal and ground plane 1104 is an effective shunt capacitance between conductive path 1108 and ground plane 1104. This capacitance, illustrated as capacitor 1312, is created by the low $Z_0$ microstrip illustrated in FIG. 11(*c*).

In the output area, there is an effective shunt capacitance between conductive path 1108 and ground plane 1112 created by the width of conductive path 1108 in this area, as illustrated by capacitor 1322. Similarly, the width of conductive path 1110 results in an effective shunt capacitance between conductive path 1110 and ground plane 1112, as illustrated by capacitor 1324.

After the transition when conductive paths 1108, 1110 are separated but before they are over floating ground 1112, the signals traveling thereon see an effective series inductance. This is illustrated by inductors 1314 and 1316. The amount of inductance is proportional to the length of conductive paths 1108, 1110 in this region. Because this series inductance is undesirable, this length is kept as short as possible. Also, additional capacitance is preferably added at both ends of signal paths 1108, 1110 to tune out this inductance. This additional capacitance is added by increasing the width of signal paths 1108, 1109 and 1110 in and near the transition area. One example of this is illustrated in FIG. 11(*c*).

Note that ground 1332 (i.e. ground plane 1112) at the output is floating with respect to input ground 1334 (ground plane 1104).

Figure 1:
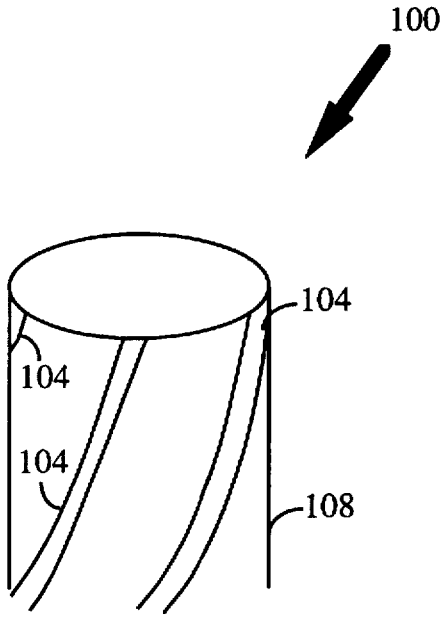
FIG. 1 illustrates a microstrip quadrifilar helix antenna.

For proper operation of a quadrifilar helix antenna such as that illustrated in FIG. 1, the transmitted signal must be divided into 0°, 90°, 180° and 270° signal. Similarly, the received 0°, 90°, 180° and 270° signals must be combined into a single receive signal. To accomplish this, feed circuit 308 is provided. In this section, several embodiments of feed circuit 308 are disclosed. These embodiments use a combination of the 180° power divider 1100 and the branch line couplers described above in Section 3 of this document.

Figure 14:
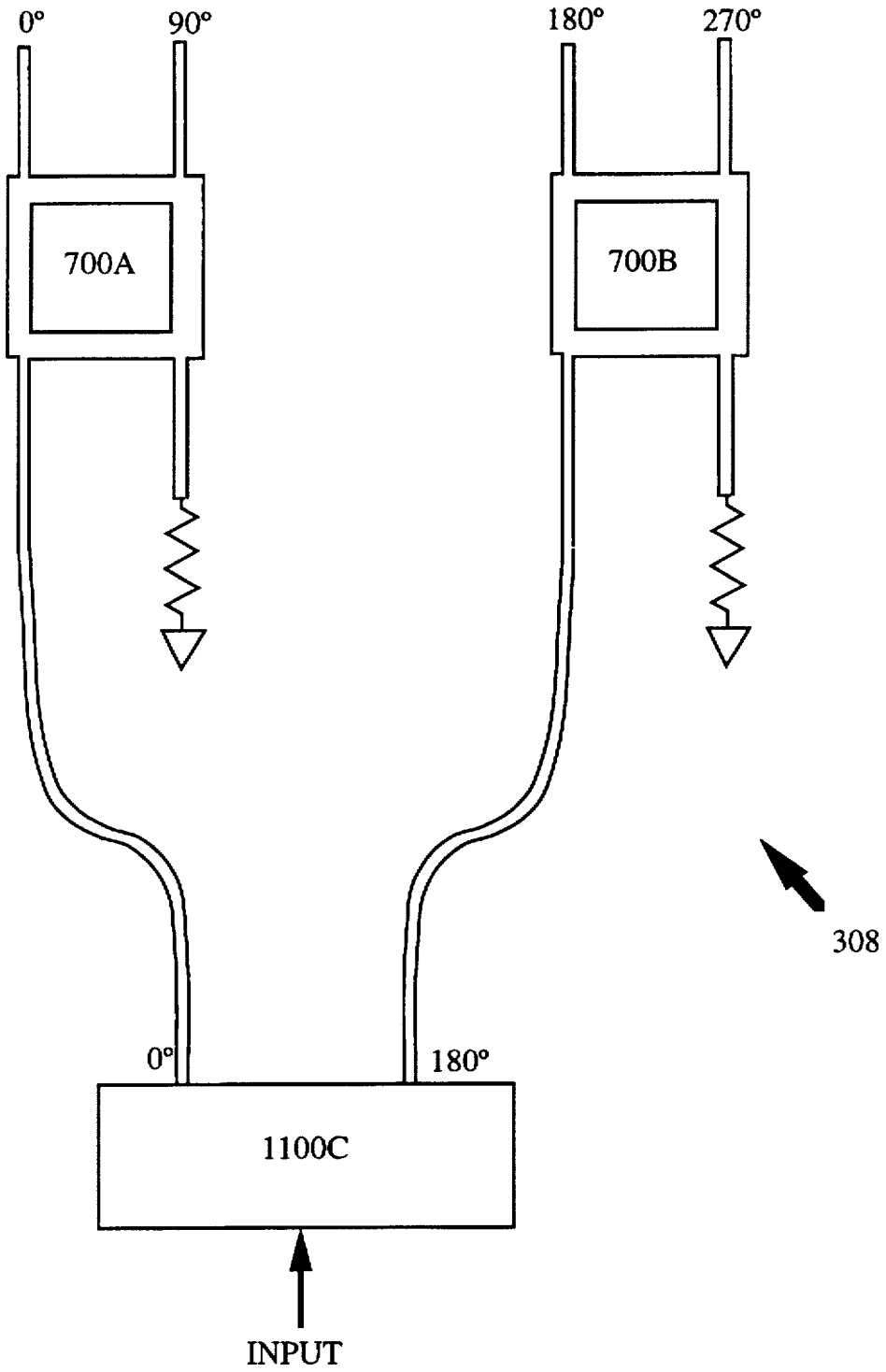
FIG. 14 illustrates a narrow-band feed network having a 180° power divider and two branch line couplers according to one embodiment of the invention.

A first embodiment of feed circuit 308 combines two single-section branch line couplers 700 and one 180° power divider 1100. This embodiment is illustrated in FIG. 14. According to this embodiment, an input signal is provided to the feed network at a point C. 180° power divider 1100 splits the input signal into two signals that differ in phase by 180°. These are referred to as a 0° signal and a 180° signal. Each of these signals is fed into a single-section branch line coupler 700. Specifically, the 0° signal is fed into branch line coupler 700A, and the 180° signal into branch line coupler 700B.

Branch line couplers 700A, 700B each provide two outputs that are of equal amplitude but that differ in phase by 90°. These are referred to as a 0° signal and a 90° signal. Because the input to branch line coupler 700A differs from the input to branch line coupler 700B by 180°, the 0° and 90° output signals from branch line coupler 700A differ from the 0° and 90° output signals from branch line coupler 700B by 180°. As a result, at the output of the feed network are the 0°, 90°, 180° and 270° signals required to feed the quadrifilar antenna. Each of these 0°, 90°, 180° and 270° signals is fed to radiators 104A, 104B, 104C, and 104D, respectively.

Figure 15:
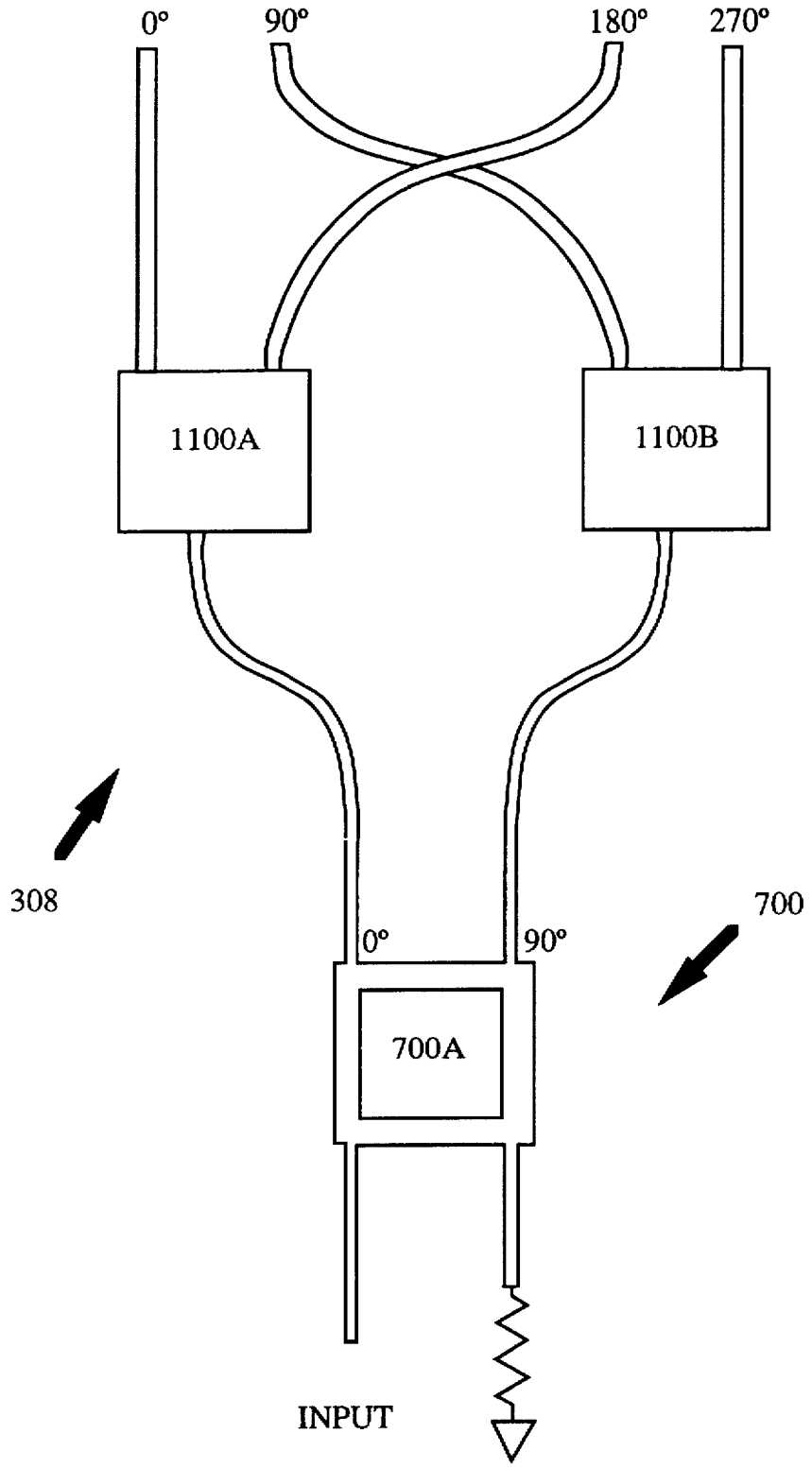
FIG. 15 illustrates a narrow-band feed network having two 180° power dividers and a branch-line coupler according to one embodiment of the invention.

Another embodiment of feed circuit 308, illustrated in FIG. 15 uses two 180° power dividers 1100 and one single-section branch line coupler 700. According to this embodiment, single-section branch line coupler 700 first splits the input signal to form two output signals of equivalent amplitude that differ from each other by 90°. These 0° and 90° degree output signals are fed into 180° power divider 1100A and 180° power divider 1100B, respectively. Because each 180° power divider 1100 produces two outputs that are of equal amplitude but that differ in phase by 180°, the outputs of the two 180° power dividers 1100 are the 0°, 90°, 180° and 270° signals.

Note, however, that these signals are not in the correct order. 180° power divider 1100A provides the 0° and 180° signals, while 180° power divider 1100B provides the 90° and 270° signals. Thus, to provide the signals to radiators 104 in the correct order, the 90° and 180° conductive paths must change relative positions.

One way to change the relative position of the signals is to feed one of these two signals to bottom surface 200 until it passes across the other signal. At this position the signal trace is etched as a patch on bottom surface 200. Around the patch is a clearing where there is no ground plane. This clearing, however, has a negative impact on the ground. Therefore, it is desirable to leave the ground as a continuous plane without any clearing whatsoever.

In an alternative embodiment, the signal positions are exchanged by running one conductive path across the other conductive path with an insulating bridge between the two conductive paths. This allows the ground plane to be continuous. In yet another alternative embodiment, the crossing is made by running the signal trace across the ground plane using an insulating section between the crossing signal and the ground plane. In this alternative, the only interruption is for the vias allowing the signal to pass through the ground plane on bottom surface 200.

Although feed circuit 308 is described herein in terms of a quadrifilar helix antenna requiring 0°, 90°, 180° and 270° signals, after reading the above description, it will be apparent to a person skilled in the art how to implement the disclosed techniques with other antenna configurations requiring 0°, 90°, 180° and 270° signals. Furthermore, it will become apparent to a person skilled in the art how to use 180° power divider 1100 in other environments requiring two signals that differ in phase by 180°.

It should be noted that the layout diagrams provided herein are provided to illustrate the functionality of the components, and not necessarily to depict an optimum layout. Based on the disclosure provided herein, including that provided by the illustrations, optimum layouts are obtainable using standard layout optimization techniques, considering materials, power, space, and size constraints. However, example layouts are described below for branch line coupler 700 and 180° power divider 1100.

FIG. 16 is a layout diagram illustrating a layout for the feed network illustrated in FIG. 15. Referring now to FIG. 16, branch line coupler 700 is shown in a layout that is more area efficient than the configuration illustrated in FIG. 7. 180° power dividers 1100 are illustrated as having large traces at interface areas to increase the capacitance and decrease the characteristic impedance. Also illustrated in FIG. 16 is a cross-over section 1604 where the 90° and 180° signals are crossed. Solid outlines without hashing 1622 illustrate an outline of the traces on bottom surface 200. The hashed areas indicate the traces on top surface 300.

Figure 17A:
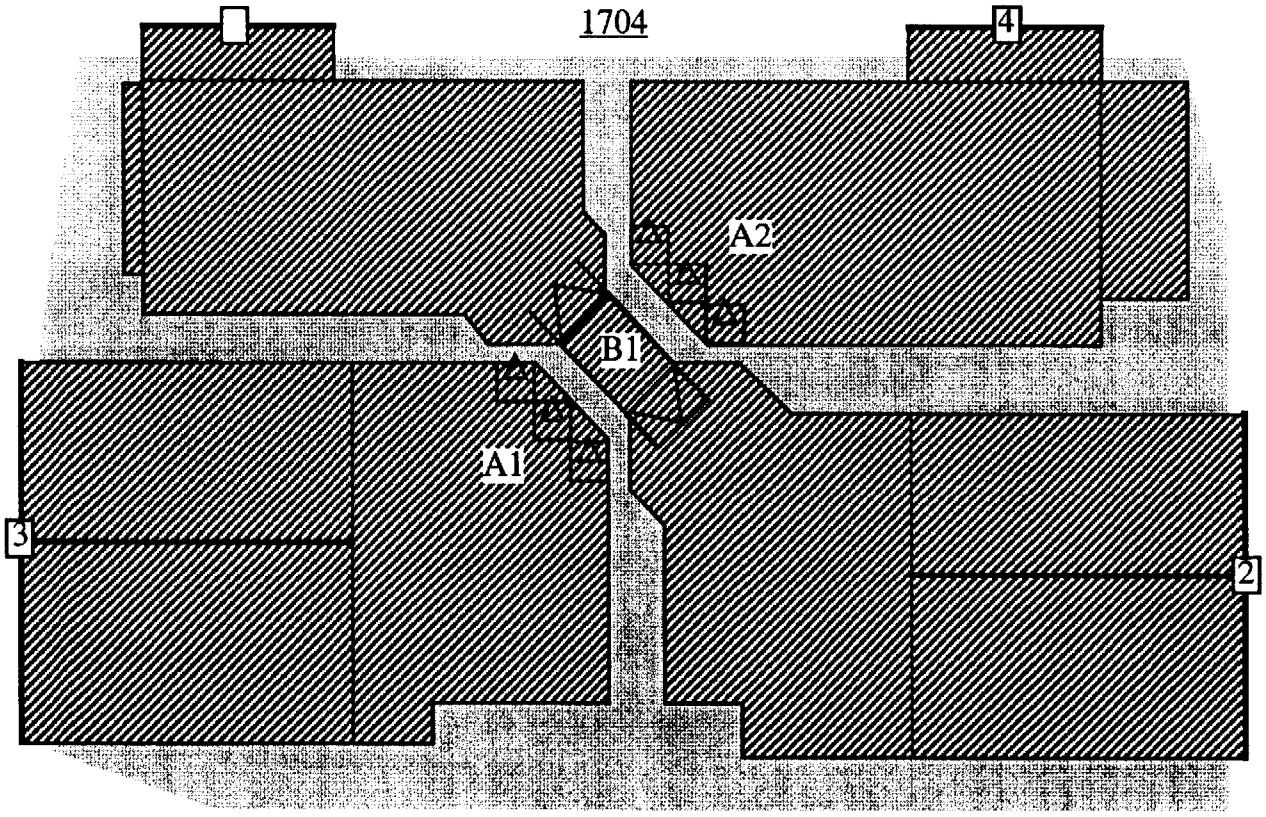
FIG. 17(*a*) illustrates an expanded view of one embodiment of a cross-over section of a feed network such as that illustrated in FIG. 16.
Figure 17B:
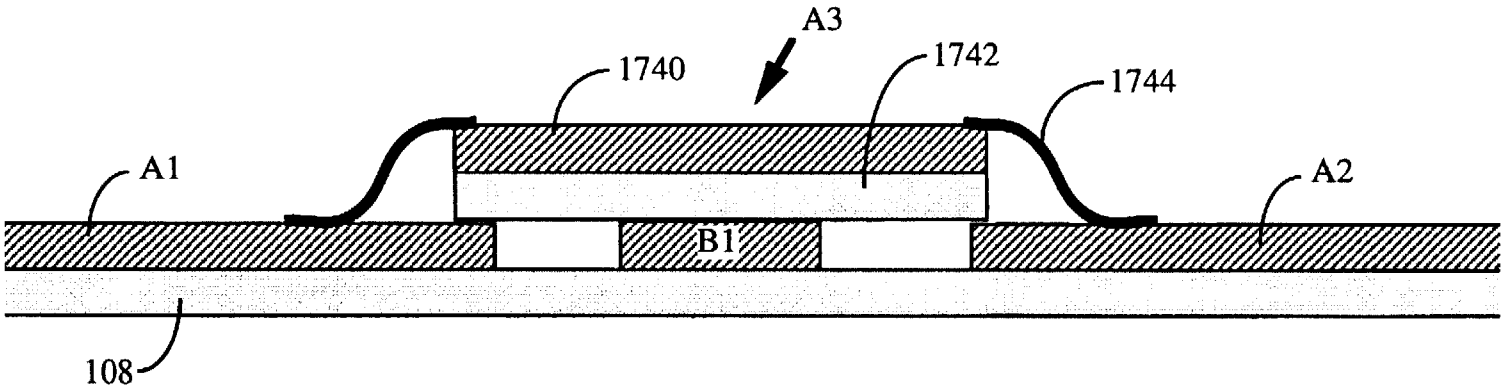

FIG. 17(*a*) is an expanded view of cross-over section 1604. Note that a conductive bridge to connect path A1 to path A2 is not illustrated in FIG. 17(*a*). As illustrated in FIGS. 16 and 17(*a*), the conductive signal paths exchange relative positions. The signal on conductive path A1 bridges over conductive path B1 to conductive path A2. FIG. 17(*b*) illustrates the conductive bridge A3 used to electrically connect (bridge) conductive path A1 to conductive path A2. In the embodiment illustrated in FIG. 17(*b*), conductive bridge A3 is implemented as a conductor 1740 mounted on an insulating material 1742. In the embodiment illustrated, conductive tape 1744 or other conductive means, such as but not limited to solder or wires, are used to electrically connect conductor 1740 to conductive paths A1, A2. In one alternative embodiment, conductor A3 is longer than insulating material 1742 and electrically connected to paths A1, A2.

Figure 18:
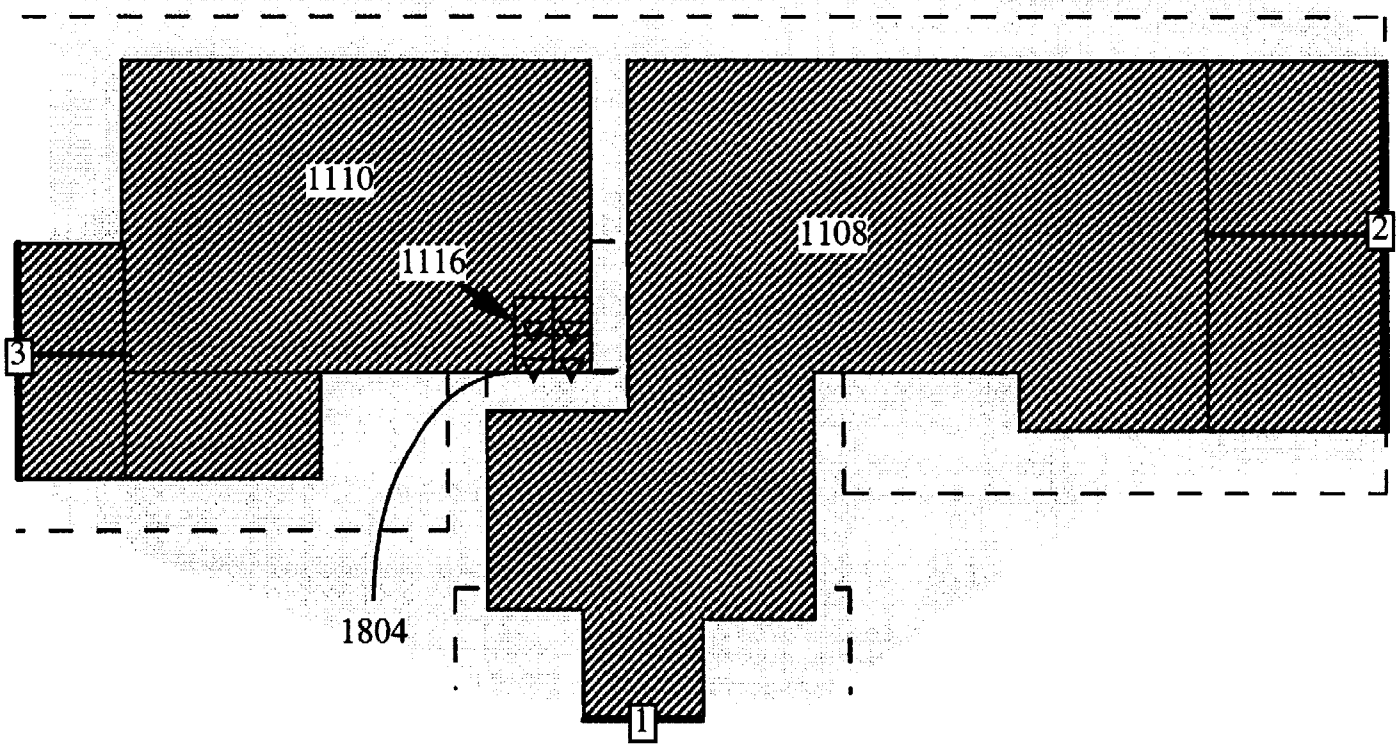
FIG. 18 illustrates an exemplary layout for the top surface of the microstrip substrate for a 180° power divider.
Figure 19:
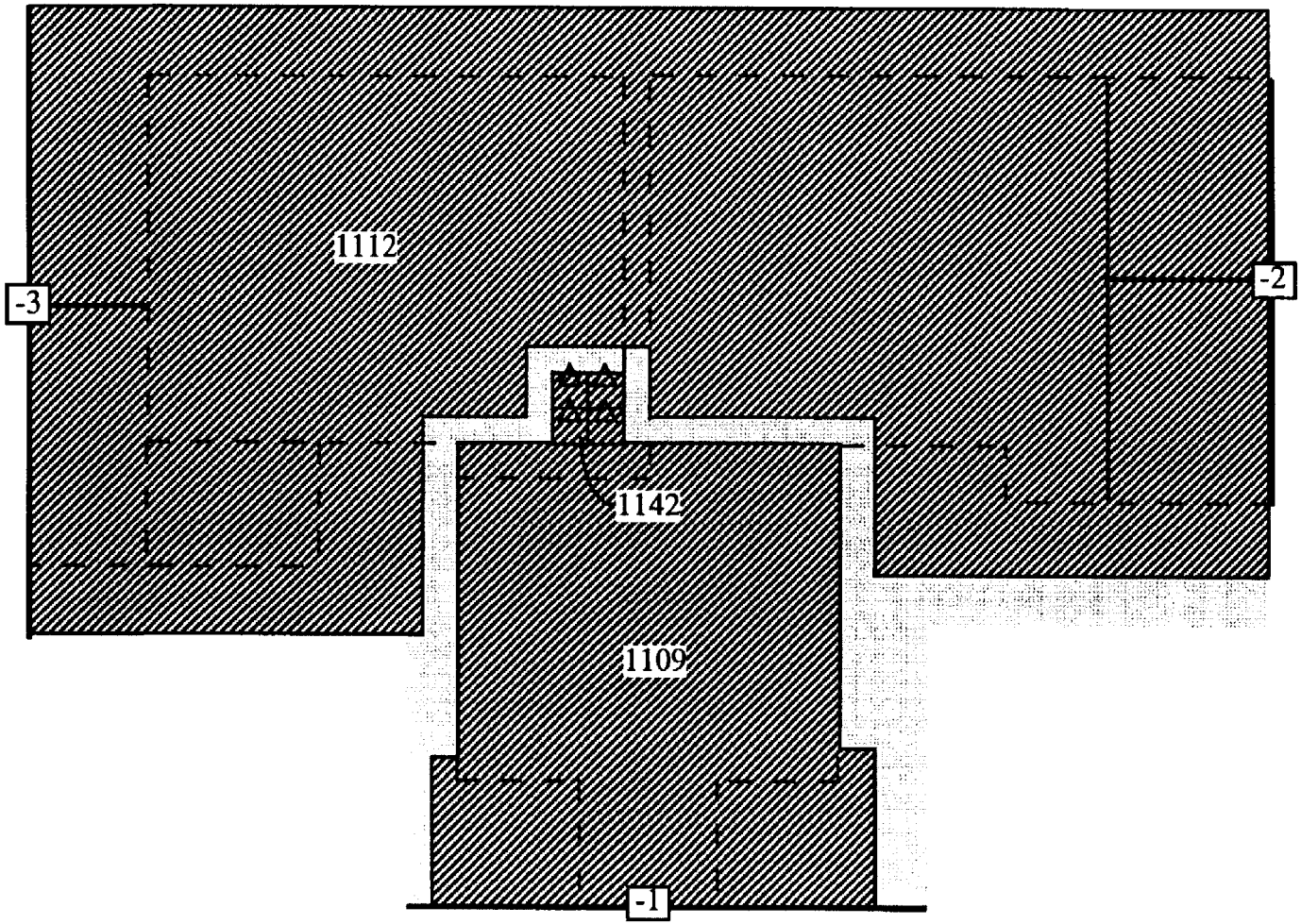
FIG. 19 illustrates an exemplary layout for a portion of the bottom surface the microstrip substrate for a 180° power divider.

FIGS. 18 and 19 illustrate the traces on the top and bottom surfaces of the microstrip substrate. FIG. 18 illustrates an exemplary layout for conductive paths 1108 and 1110. Also illustrated is an area 1804 where via 1116 is located to connect to tab 1142. FIG. 19 illustrates ground plane 1112, return conductive path 1109 and tab 1142.

Figure 20:
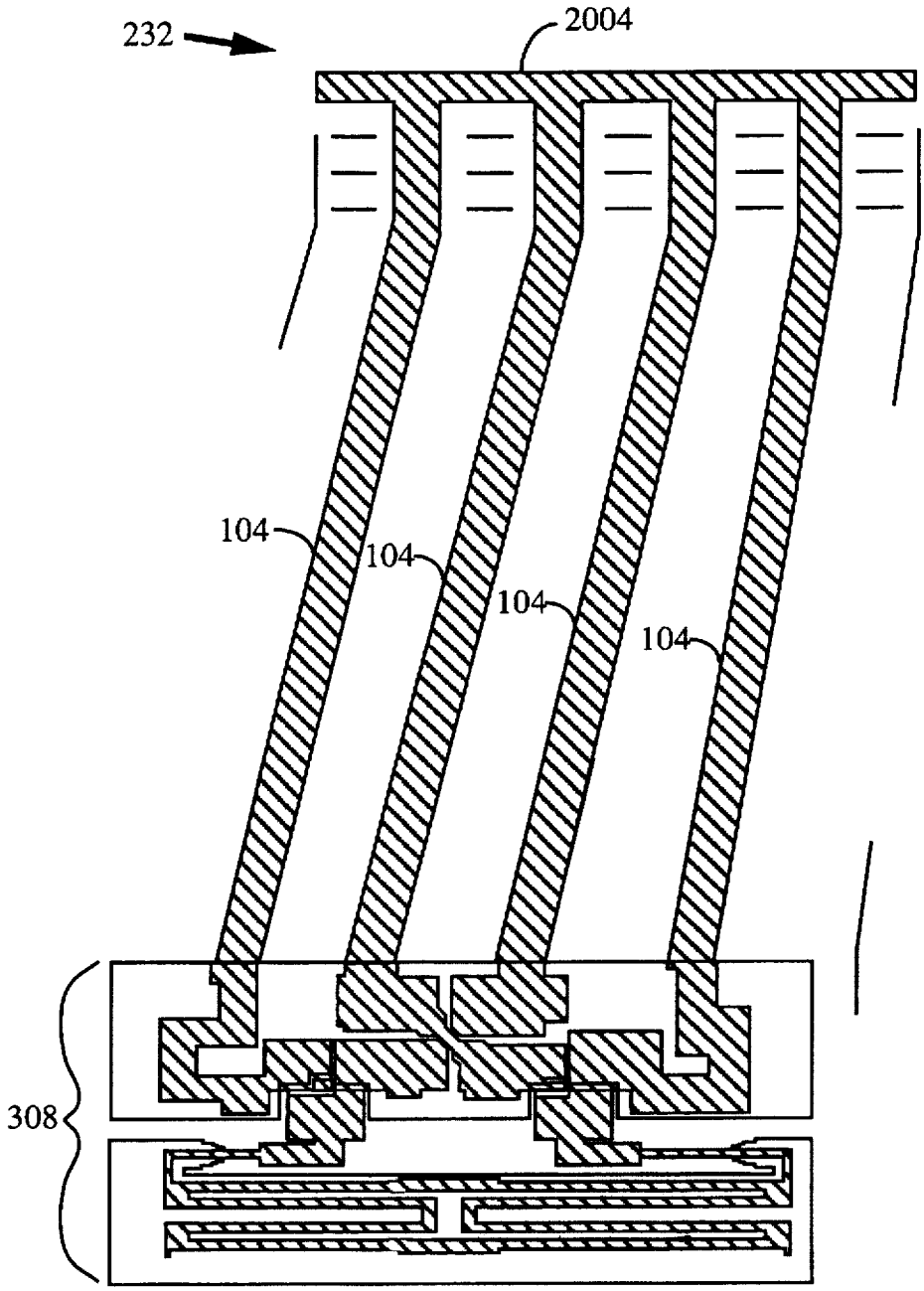
FIG. 20 illustrates an exemplary layout of a quadrifilar helix antenna using the feed network illustrated in FIG. 16.

FIG. 20 illustrates an exemplary layout of a quadrifilar helix antenna using the feed network 308 illustrated in FIG. 16. Note that in this embodiment, radiators 104 are shorted at second end 234 by signal trace 2004.

Note that, it will be apparent to a person skilled in the relevant art after reading this document that although the various ground planes are illustrated solid ground planes, other ground configurations may be utilized depending on the feed network and/or antenna implemented. Other ground configurations can include, for example, ground meshes, perforated ground planes and the like.

6. Conclusion

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What we claim is:

1. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°;

wherein said first and second power dividers each comprise:

a substrate, a first conductive path disposed on a first surface of said substrate, a ground portion disposed on a second surface of said substrate forming a ground plane and tapering from said ground plane to form a second conductive path having a width that is substantially equal to the width of said first conductive path and being positioned on said second surface substantially in alignment with said first conductive path, a third conductive path disposed on said first surface of said substrate, a tab disposed on said second surface and extending from said second conductive path, and an electrical connection between said tab on said second surface and said third conductive path on said first surface.

2. The antenna of claim 1 wherein said branch line coupler is a single section branch line coupler.

3. The antenna of claim 1 wherein said branch line coupler is a double section branch line coupler.

4. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°;

wherein said first and second power dividers each comprise:

a substrate, a first conductive path disposed on a first surface of said substrate, a ground portion disposed on a second surface of said substrate forming a ground plane and tapering from said ground plane to form a second conductive path having a width that is substantially equal to the width of said first conductive path and being positioned on said second surface substantially in alignment with said first conductive path, a third conductive path disposed on said first surface of said substrate, and an electrical connection between said second conductive path and said third conductive path.

5. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°;

wherein said first and second power dividers each comprise:

a substrate having an input area, a transition area, and an output area, a first conductive path disposed on a first surface of said substrate and spanning said input area, said transition area and said output area, a ground portion disposed on a second surface of said substrate forming a ground plane in said input area of said substrate, and tapering from the ground plane to form a tapered portion in said transition area of said substrate, a second conductive path extending from said tapered portion on said second surface of said substrate and having a width that is substantially equal to the width of said first conductive path and being positioned on said second surface substantially in alignment with said first conductive path, a third conductive path disposed on said first surface of said substrate in said output area of said substrate, a tab disposed on said second surface and extending from said second conductive path, and an electrical connection between said tab on said second surface and said third conductive path on said first surface.

6. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°;

wherein said first and second power dividers each comprise:

a substrate having an input area a transition area and an output area, a first conductive path disposed on a first surface of said substrate and spanning said input area, said transition area and said output area, a ground portion disposed on a second surface of said substrate forming a ground plane in said input area of said substrate, and tapering from the ground plane to form a tapered portion in said transition area of said substrate, a second conductive path extending from said tapered portion on said second surface of said substrate and having a width that is substantially equal to the width of said first conductive path and being positioned on said second surface substantially in alignment with said first conductive path, a third conductive path disposed on said first surface of said substrate in said output area of said substrate, and an electrical connection between said second conductive path on said second surface and said third conductive path on said first surface.

7. The antenna of claim 6, wherein at least one of said first, second and third conductive paths are wider in said output area of said substrate to reduce the characteristic impedance of the device.

8. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a power divider for providing from an input signal first and second output signals that differ from each other by 180°, wherein said power divider comprises:

a substrate, a first conductive path disposed on a first surface of said substrate, a ground portion disposed on a second surface of said substrate forming a ground plane and tapering from said ground plane to form a second conductive path having a width that is substantially equal to the width of said first conductive path and being positioned on said second surface substantially in alignment with said first conductive path, a third conductive path disposed on said first surface of said substrate, a tab disposed on said second surface and extending from said second conductive path, and an electrical connection between said tab on said second surface and said third conductive path on said first surface;

a first branch line coupler having an input arm for accepting said first signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a first output arm for providing a first output signal and a second output arm for providing a second output signal, wherein said first and second output signals differ from one another by 90°.

9. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a power divider for providing from an input signal first and second output signals that differ from each other by 180°, wherein said power divider comprises:

a substrate, a first conductive path disposed on a first surface of said substrate, a ground portion disposed on a second surface of said substrate forming a ground plane and tapering from said ground plane to form a second conductive path having a width that is substantially equal to the width of said first conductive path and being positioned on said second surface substantially in alignment with said first conductive path, a third conductive path disposed on said first surface of said substrate, and an electrical connection between said second conductive path and said third conductive path;

a first branch line coupler having an input arm for accepting said first signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a first output arm for providing a first output signal and a second output arm for providing a second output signal, wherein said first and second output signals differ from one another by 90°.

10. A quadrifilar helix antenna, comprising:

four radiators etched onto a radiator portion of a microstrip substrate; and a feed network etched onto a feed portion of said microstrip substrate and providing 0°, 90°, 180° and 270° signals to said radiators, said feed network comprising:

a power divider for providing from an input signal first and second output signals that differ from each other by 180°, wherein said power divider comprises:

a substrate having an input area a transition area and an output area, a first conductive path disposed on a first surface of said substrate and spanning said input area, said transition area and said output area, a ground portion disposed on a second surface of said substrate forming a ground plane in said input area of said substrate, and tapering from the ground plane to form a tapered portion in said transition area of said substrate, a second conductive path extending from said tapered portion on said second surface of said substrate and having a width that is substantially equal to the width of said first conductive path and being positioned on said second surface substantially in alignment with said first conductive path, a third conductive path disposed on said first surface of said substrate in said output area of said substrate, a tab disposed on said second surface and extending from said second conductive path, and an electrical connection between said tab on said second surface and said third conductive path on said first surface;

a first branch line coupler having an input arm for accepting said first signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a first output arm for providing a first output signal and a second output arm for providing a second output signal, wherein said first and second output signals differ from one another by 90°.

11. A quadrifilar helix antenna, comprising:

four radiators etched onto a radiator portion of a microstrip substrate:

a feed network etched onto a feed portion of said microstrip substrate and providing 0°, 90°, 180° and 270° signals to said radiators, said feed network comprising:

a power divider for providing from an input signal first and second output signals that differ from each other by 180°, wherein said power divider comprises:

a substrate having an input area a transition area and an output area, a first conductive path disposed on a first surface of said substrate and spanning said input area, said transition area and said output area, a ground portion disposed on a second surface of said substrate forming a ground plane in said input area of said substrate, and tapering from the ground plane to form a tapered portion in said transition area of said substrate, a second conductive path extending from said tapered portion on said second surface of said substrate and having a width that is substantially equal to the width of said first conductive path and being positioned on said second surface substantially in alignment with said first conductive path.

a third conductive path disposed on said first surface of said substrate in said output area of said substrate, and an electrical connection between said second conductive path on said second surface and said third conductive path on said first surface;

a first branch line coupler having an input arm for accepting said first signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a first output arm for providing a first output signal and a second output arm for providing a second output signal, wherein said first and second output signals differ from one another by 90°.

12. The antenna of claim 11, wherein at least one of said first, second and third conductive paths are wider in said output area of said substrate to reduce the characteristic impedance of the device.

* * * * *